US009828976B2

(12) United States Patent
Steffen et al.

(10) Patent No.: US 9,828,976 B2
(45) Date of Patent: Nov. 28, 2017

(54) PUMP FOR CRYOGENIC LIQUIDS HAVING TEMPERATURE MANAGED PUMPING MECHANISM

(71) Applicant: Caterpillar Inc., Peoria, IL (US)

(72) Inventors: Joshua Steffen, El Paso, IL (US); Shivangini Singh Hazari, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 331 days.

(21) Appl. No.: 14/610,972

(22) Filed: Jan. 30, 2015

(65) Prior Publication Data

US 2016/0222955 A1 Aug. 4, 2016

(51) Int. Cl.

| | |
|---|---|
| ***F04B 1/14*** | (2006.01) |
| ***F04B 1/12*** | (2006.01) |
| ***F04B 39/12*** | (2006.01) |
| ***F04B 39/14*** | (2006.01) |
| ***F04B 53/00*** | (2006.01) |

(Continued)

(52) U.S. Cl.

CPC ..... *F04B 1/143* (2013.01); *F04B 1/124* (2013.01); *F04B 39/122* (2013.01); *F04B 39/14* (2013.01); *F04B 53/007* (2013.01); *F04B 53/16* (2013.01); *F04B 53/22* (2013.01); *F04B 2015/081* (2013.01)

(58) Field of Classification Search

CPC .. F04B 1/143; F04B 1/124; F04B 1/12; F04B 1/122; F04B 1/14; F04B 1/16; F04B 2015/081; F04B 2015/0822; F04B 2015/0826; F04B 23/021; F04B 23/023; F04B 39/0238; F04B 39/06; F04B 39/12; F04B 39/121; F04B 39/122; F04B 39/125; F04B 41/02; F04B 53/08; F04B 53/162; F04B 2207/03; F04B 19/06; F04B 37/08; F04B 53/007; F04B 53/22; F04B 39/14; F04B 39/006; F16J 13/10; F15B 15/1485; F15B 15/1438

See application file for complete search history.

(56) References Cited

U.S. PATENT DOCUMENTS

| | | | |
|---|---|---|---|
| 2,837,989 | A | 6/1958 | Ahlstrand |
| 3,136,136 | A | 6/1964 | Gottzmann |

(Continued)

FOREIGN PATENT DOCUMENTS

| | | | |
|---|---|---|---|
| CA | 2 546 315 | A1 | 11/2006 |
| CN | 101403381 | A | 4/2009 |

(Continued)

OTHER PUBLICATIONS

U.S. Appl. No. 14/597,019, titled "Bearing Arrangement for Cryogenic Pump," filed Jan. 14, 2015, 21 pages.

*Primary Examiner* — Bryan Lettman
*Assistant Examiner* — Timothy Solak
(74) *Attorney, Agent, or Firm* — Finnegan, Henderson, Farabow, Garrett & Dunner, L.L.P.

(57) ABSTRACT

A pump for cryogenic liquids including plurality of temperature managed pumping mechanisms. Each pumping mechanism including a barrel having a first end and a second end, and at least one bore extending through the barrel from the first end to the second end. The pump barrel including a stabilizer positioned on the first end and at least partially defining a space in fluid communication with the at least one bore to provide cooling to the barrel.

19 Claims, 3 Drawing Sheets

(51) Int. Cl.

| | |
|---|---|
| ***F04B 53/22*** | (2006.01) |
| ***F04B 53/16*** | (2006.01) |
| *F04B 15/08* | (2006.01) |

(56) References Cited

U.S. PATENT DOCUMENTS

| | | | | | |
|---|---|---|---|---|---|
| 3,175,510 | A * | 3/1965 | D Amato | F04B 1/124 | 91/505 |
| 3,206,110 | A * | 9/1965 | Waibel | F04B 37/12 | 417/564 |
| 4,239,463 | A | 12/1980 | Yaindl | | |
| 4,376,377 | A | 3/1983 | Duron et al. | | |
| 4,393,752 | A | 7/1983 | Meier | | |
| 4,396,362 | A | 8/1983 | Thompson et al. | | |
| 4,576,557 | A | 3/1986 | Pevzner | | |
| 5,085,563 | A | 2/1992 | Collins et al. | | |
| 5,121,730 | A | 6/1992 | Ausman et al. | | |
| 5,127,230 | A | 7/1992 | Neeser et al. | | |
| 5,265,431 | A | 11/1993 | Gaudet et al. | | |
| 5,456,158 | A * | 10/1995 | Ikeda | F04B 27/1081 | 411/176 |
| 5,509,792 | A | 4/1996 | Sullivan et al. | | |
| 5,511,955 | A | 4/1996 | Brown et al. | | |
| 5,522,709 | A | 6/1996 | Rhoades | | |
| 5,809,863 | A | 9/1998 | Tominaga et al. | | |
| 5,860,798 | A | 1/1999 | Tschopp | | |
| 5,899,136 | A | 5/1999 | Tarr et al. | | |
| 6,006,525 | A | 12/1999 | Tyree, Jr. | | |
| 6,056,520 | A | 5/2000 | Nguyen et al. | | |
| 6,092,998 | A * | 7/2000 | Dexter | F04B 1/143 | 417/269 |
| 6,149,073 | A | 11/2000 | Hickey et al. | | |
| 6,481,218 | B1 | 11/2002 | Drelser | | |
| 6,663,350 | B2 | 12/2003 | Tyree, Jr. | | |
| 6,722,866 | B1 | 4/2004 | Dresler | | |
| 6,898,940 | B2 | 5/2005 | Gram et al. | | |
| 6,901,911 | B2 | 6/2005 | Anderson et al. | | |
| 7,134,851 | B2 | 11/2006 | Chenoweth | | |
| 8,790,091 | B2 | 7/2014 | Mehta et al. | | |
| 2004/0042906 | A1 * | 3/2004 | Gleasman | F04B 1/126 | 417/222.1 |
| 2007/0009367 | A1 * | 1/2007 | Tischler | F04B 1/124 | 417/269 |
| 2008/0093361 | A1 * | 4/2008 | Kennedy | F04B 47/08 | 220/233 |
| 2009/0159053 | A1 | 6/2009 | Stockner et al. | | |
| 2010/0037967 | A1 | 2/2010 | Lu | | |
| 2010/0288239 | A1 | 11/2010 | Morris et al. | | |
| 2012/0090461 | A1 * | 4/2012 | Kita | F04B 39/122 | 92/169.1 |
| 2013/0306029 | A1 | 11/2013 | Stockner et al. | | |
| 2014/0109599 | A1 | 4/2014 | Lefevre et al. | | |
| 2014/0116396 | A1 | 5/2014 | Stockner | | |
| 2014/0130522 | A1 | 5/2014 | Steffen et al. | | |
| 2014/0174106 | A1 | 6/2014 | Tang et al. | | |
| 2014/0182559 | A1 | 7/2014 | Steffen et al. | | |
| 2014/0193281 | A1 | 7/2014 | Shaull et al. | | |
| 2014/0216403 | A1 | 8/2014 | Stockner | | |

FOREIGN PATENT DOCUMENTS

| | | | |
|---|---|---|---|
| DE | 3515757 | A1 | 11/1986 |
| KR | 10-1104171 | B1 | 1/2012 |
| KR | 10-2013-0089584 | A | 8/2013 |
| WO | WO 99/13229 | A1 | 3/1999 |

* cited by examiner

PUMP FOR CRYOGENIC LIQUIDS HAVING TEMPERATURE MANAGED PUMPING MECHANISM

TECHNICAL FIELD

The present disclosure relates generally to a pump and, more particularly, to a pump having axial cooling.

BACKGROUND

Gaseous fuel powered engines are common in many applications. For example, the engine of a locomotive can be powered by natural gas (or another gaseous fuel) alone or by a mixture of natural gas and diesel fuel. Natural gas may be more abundant and, therefore, less expensive than diesel fuel. In addition, natural gas may burn cleaner in some applications.

Natural gas, when used in a mobile application, is generally stored in a liquid state onboard the associated machine. This may require the natural gas to be stored at cold temperatures, typically below about −150° C. The liquefied natural gas is then drawn from the tank by a charge pump and directed via separate passages to individual plungers of a high-pressure pump. The high-pressure pump further increases a pressure of the fuel and directs the fuel to the machine's engine. In some applications, the liquid fuel is gasified prior to injection into the engine and/or mixed with diesel fuel (or another fuel) before combustion.

One problem associated with conventional high-pressure pumps involves large temperature differences that can cause thermal distortion and stress challenges in components of the pump. Specifically, the pumps often have bolted joints, which can be subject to thermal expansion. This thermal expansion, if not accounted for, can cause failure of the joint.

One attempt to improve longevity of a cryogenic pump is disclosed in U.S. Pat. No. 5,860,798 (the '798 patent) that issued to Tschopp on Jan. 19, 1999. In particular, the '798 patent discloses a pump having a piston that reciprocates within a bush to propel a cryogenic fluid. A sleeve-like bearer defines an inlet for the pump and houses the bush with an Intermediate space in between. In operation, a portion of the cryogenic fluid is diverted from the inlet into the intermediate space to thermally insulate the bush. This feature is intended to ensure a steady stream of cryogenic fluid by preventing gas bubbles or warm fluid inside the bush.

While the pump of the '798 patent may inhibit heat transfer within the pump and thereby increase longevity of the pump, it may still be less than optimal, in particular, the '798 patent has a simple design limited to a single piston. Further, the design focuses on insulation of the cryogenic fluid and does not take into account the components (e.g. bolted joints) of the pump.

The disclosed pump is directed to overcoming one or more of the problems set forth above.

SUMMARY

In one aspect, the present disclosure is directed to a pump barrel. The pump barrel may include an elongated body having a first end and a second end. At least one bore may extend through the elongated body from the first end to the second end. The pump barrel may also include a stability feature positioned on the first end and at least partially defining an axial space in fluid communication with the at least one bore.

In another aspect, the present disclosure is directed to a pump barrel including an elongated body having a first end, a second end, and a longitudinal axis. The elongated body may include a plurality of bores passing from the first end through the second end, a central bore passing from the first end through the second end at a location centered between the plurality of bores, and a peripheral bore passing from the first end through the second end. A first stability feature may be positioned on the first end at least partially defining a first axial space in communication with the plurality of bores, and a second stability feature may be positioned on the second end and at least partially defining a second axial space in communication with the plurality of bores. A first and second central rim may be positioned on the first and second ends, respectively, circumventing around the central bore. A first and second conduit rim may be positioned on the first and second ends, respectively, circumventing around the peripheral bore and being diametrically opposite the first and second stability features relative to the longitudinal axis.

In yet another aspect, the present disclosure is directed to a pump. The pump may include a barrel having an elongated body with a first end and a second end, a plurality of bores passing from the first end through the second end, and a central bore passing from the first end through the second end at a location centered between the plurality of bores. A first stability feature may be positioned on the first end and at least partially defining a first axial space in communication with the plurality of bores, and a second stability feature may be positioned on the second end and at least partially defining a second axial space in communication with the plurality of bores. A first central rim may be positioned on she first end circumventing around the central bore, and a second central rim may be positioned on the second end circumventing around the central bore. A plunger may be positioned within the central bore. A manifold may be positioned on the first end of the barrel, and a head may be positioned on the second end of the barrel. A plurality of bolts may be positioned within the plurality of bores to secure the barrel between the manifold and the head.

DETAILED DESCRIPTION

Figure 1:
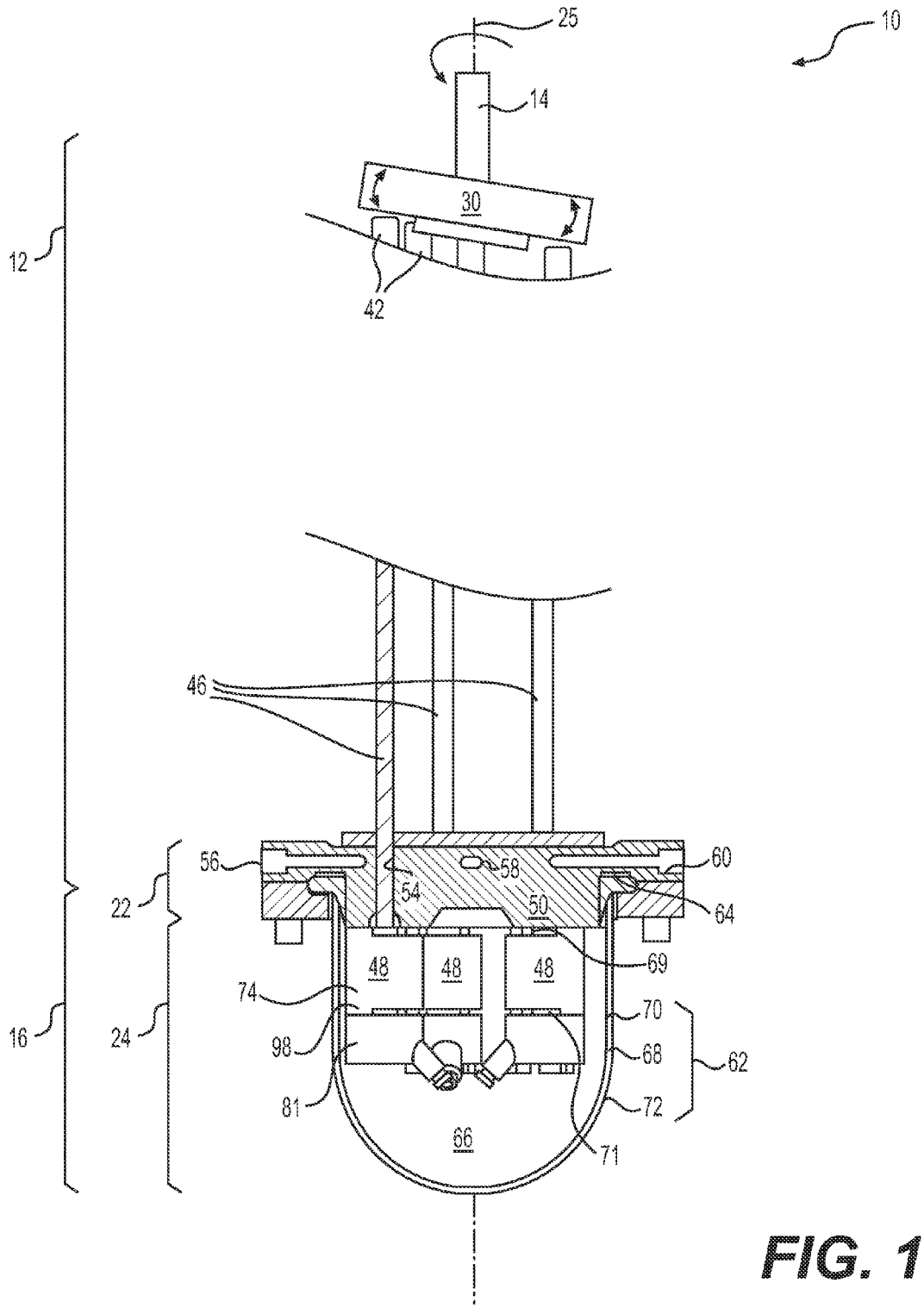
FIG. 1 is a cross-sectional illustration of an exemplary disclosed pump.

FIG. 1 illustrates an exemplary pump 10. In one embodiment, pump 10 is mechanically driven by an external source of power (e.g., by a combustion engine or an electric motor—not shown), to generate a high-pressure fluid discharge. In the disclosed embodiment the fluid passing through pump 10 is liquefied natural gas (LNG) intended to be consumed by the power source providing the mechanical input. It is contemplated, however, that pump 10 may alternatively or additionally be configured to pressurize and discharge a different cryogenic fluid, if desired. For example, the cryogenic fluid could be liquefied helium, hydrogen, nitrogen, oxygen, or another fluid known in the art.

Pump 10 may be generally cylindrical and divided into two ends. For example, pump 10 may be divided into a warm or input end 12, in which a driveshaft 14 is supported, and a cold or output end 16. Cold end 16 may be further divided into a manifold section 22 and a reservoir section 24. Each of these sections may be generally aligned with driveshaft 14 along a common axis 25, and connected end-to-end. With this configuration, a mechanical input may be provided to pump 10 at warm end 12 (i.e., via shaft 14), and used to generate a high-pressure fluid discharge at the opposing cold end 16. In most applications, pump 10 will be mounted and used in the orientation shown in FIG. 1 (i.e., with reservoir section 24 being located gravitationally lower than manifold section 22).

Warm end 12 may be relatively warmer than cold end 16. Specifically, warm end 12 may house multiple moving components that generate heat through friction during operation. In addition, warm end 12 being connected to the power source may result in heat being conducted from the power source into pump 10. Further, if pump 10 and the power source are located in close proximity to each other, air currents may heat warm end 12 via convection. Finally, fluids (e.g., oil) used to lubricate pump 10 may be warm and thereby transfer heat to warm end 12. In contrast, cold end 16 may continuously receive a supply of fluid having an extremely low temperature. For example, LNG may be supplied to pump 10 from an associated storage tank at a temperature less than about −150° C. This continuous supply of cold fluid to cold end 16 may cause cold end 16 to be significantly cooler than warm end 12. If too much heat is transferred to the fluid within pump 10 from warm end 12, the fluid may gasify within cold end 16 prior to discharge from pump 10, thereby reducing an efficiency of pump 10. This may be undesirable in some applications.

Pump 10 may be an axial plunger type of pump. In particular, shaft 14 may be rotatably supported within a housing (not shown), and connected at an internal end to a load plate 30. Load plate 30 may oriented at an oblique angle relative to axis 25, such that an input rotation of shaft 14 may be converted into a corresponding undulating motion of load plate 30. A plurality of tappets 42 may slide along a lower face of load plate 30, and a push rod 46 may be associated with each tappet 42. In this way, the undulating motion of load plate 30 may be transferred through tappets 42 to push rods 46 and used to pressurize the fluid passing through pump 10. A resilient member (not shown), for example a coil spring, may be associated with each push rod 46 and configured to bias the associated tappet 42 into engagement with load plate 30. Each push rod 46 may be a single-piece component or, alternatively, comprised of multiple pieces, as desired. Many different shaft/load plate configurations may be possible, and the oblique angle of shaft 14 may be fixed or variable, as desired.

Manifold section 22 may include a manifold 50 that performs several different functions. In particular, manifold 50 may function as a guide for push rods 46, as a mounting pad for a plurality of pumping mechanism 48, and as a distributer/collector of fluids for pumping mechanisms 48. Manifold 50 may connect to warm end 12, and include a plurality of bores 54 configured to receive push rods 46. In addition, manifold 50 may have formed therein a common inlet 56, a high-pressure outlet 58, and a return outlet 60, it should be noted that common inlet 56 and outlets 58, 60 are not shown in any particular orientation in FIG. 1, and that common inlet 56 and outlets 58, 60 may be disposed at any desired orientation around the perimeter of manifold 50. It is further contemplated that common inlet 56 may be disposed at an alternative location (e.g., within reservoir section 24), if desired.

Reservoir section 24 may include a close-ended jacket 62 connected to manifold section 22 (e.g., to a side of manifold 50 opposite warm end 12) by way of a gasket 64 to form an internal enclosure 66. Enclosure 66 may be in open fluid communication with common inlet 56 of manifold 50. In the disclosed embodiment, jacket 62 may be insulated, if desired, to inhibit heat from transferring inward to the fluid contained therein. For example, an air gap 68 may be provided between an internal layer 70 and an external layer 72 of jacket 62. In some embodiments, a vacuum may be formed in air gap 68.

Figure 2:
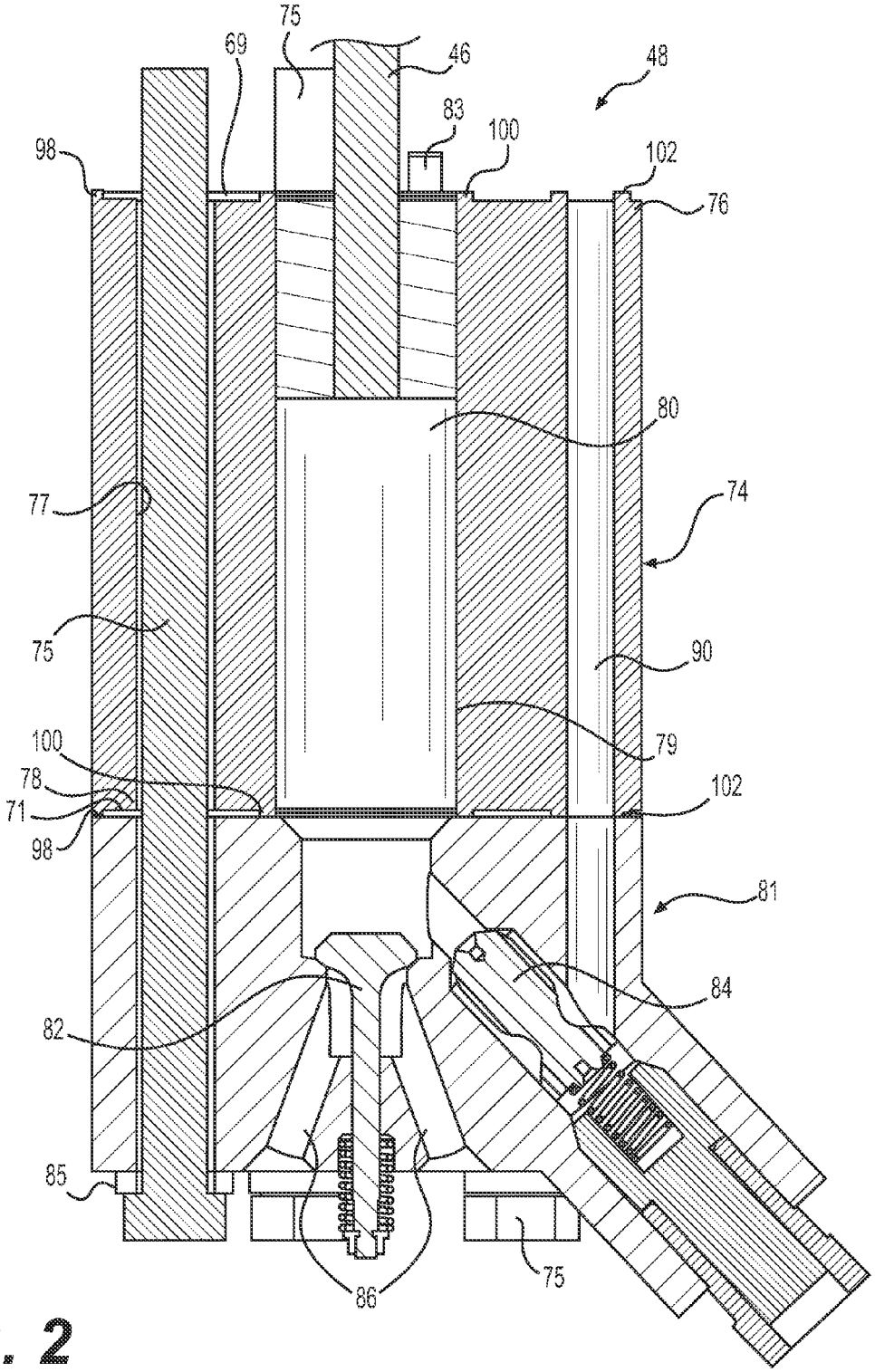
FIG. 2 is an enlarged cross-sectional illustration of an exemplary portion of the pump shown in FIG. 1.

Any number of pumping mechanisms 48 may be connected to manifold 50 and extend into enclosure 66. As shown in FIG. 2, each pumping mechanism 48 may include a generally hollow barrel 74 having an elongated body with a base end 76 connected to manifold 50, and an opposing distal end 78. A head 81 may be connected to distal end 78 to close off barrel 74. A plurality of bolts 75 may secure barrel 74 between manifold 50 and head 81. Any number of bolts 75 in any number of configurations may be used (e.g. five bolts 75 spaced equidistantly around the circumference of barrel 74). Bolts 75 can be threaded into manifold 50 or secured with a nut (not shown). A washer 85 may be positioned on the proximal end of bolt 75 to distribute the load of bolt 75 to barrel 74. One or more dowel pins 83 may also extend through head 81, barrel 74, and manifold 50 to ensure alignment. Dowel pins 83 may be integral to barrel 74 or separate components.

Barrel 74 may define a plurality of bores 77 to accommodate bolts 75, a central bore 79 to accommodate a plunger 80, and a peripheral passage 90 to accommodate high-pressure fluid flow. Bores 77, central bore 79, and passage 90 may extend parallel through barrel 74 from base end 76 to distal end 78. Central bore 79 may be positioned at a location centered between bores 77 and may have a diameter larger than a diameter of bores 77. Barrel 74 may further define a first space 69 positioned between barrel 74 and manifold 50, and a second space 71 positioned between barrel 74 and head 81. First and second spaces 69, 71 may provide fluid communication between enclosure 66 and bores 77.

Bores 77 may have a diameter larger than an outer diameter of bolts 75 to define an annular space that receives fluid from enclosure 66. The diameter of bolts 75 may be about 60-95% of the diameter of bores 77, and the fluid in the annular space may be configured to regulate the temperature of bolts 75. The annular space may also be sized to allow fluid flow due to natural heat convection. Specifically, heat may be transferred from warmer regions of bolts 75 to surrounding fluid, inducing the warmer fluid to rise relative to cooler fluid, especially when gasification occurs. The warmer fluid may rise out of bores 77 through first space 69, while cooler fluid may circulate back into bores 77 through second space 71. The continuous circulation of cooler fluid may favorably maintain the temperature and integrity of bolts 75.

Figure 3:
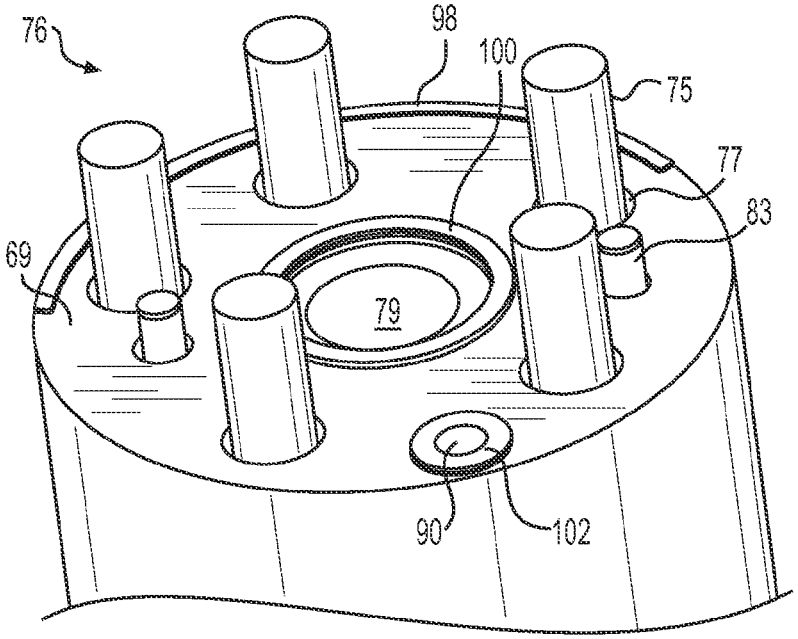
FIG. 3 is an isometric illustration of an exemplary end portion of the pump as shown in FIGS. 1 and 2.

A stabilizer may be positioned on base and distal ends 76, 78 to ensure stability and at least partially define first and second spaces 69, 71. In one embodiment, as shown in FIG. 3, the stabilizer may include a primary rim 98 extending along a partial circumference of base and distal ends 76, 78. Primary rim 98 may extend along less than 180° of the circumference of base end 76, and in some embodiments, primary rim 98 may extend along about 144° of the circumference of base end 76. In embodiments with five bores 77 equidistant around the circumference of barrel 74, as shown in FIG. 3, primary rim 98 may extend around only three of the five bores 77. This configuration may provide bores 77 fluid access without compromising structural integrity of the pumping mechanism 48.

Additional rims may be formed at each base and distal ends 76, 78 to help define first and second spaces 69, 71. For example, a central rim 100 may extend from base end 76 to circumvent around and isolate central bore 79 from first space 69. Similarly, a conduit rim 102 may extend from base end 76 to circumvent around and isolate passage 90 from first space 69. Even though FIG. 3 represents base end 76, distal end 78 may have a similar configuration.

Primary rim 98 may be positioned diametrically opposite of conduit rim 102 relative to a longitudinal axis of barrel 74, while central rim 100 may be centered along the longitudinal axis. Rims 98, 100, 102 may be centered along a high pressure area of pumping mechanism 48 to ensure stability, while maintaining spaces 69, 71. Spaces 69, 71 may have a height (defined by rims 98, 100, 102) that is about 2-5% of a diameter of barrel 74. The height of spaces 69, 71 may also be about 4-10% of a diameter of central bore 79. It is further contemplated that the height of spaces 69, 71 may be about equal to a diameter of the annular space around bolts 75. This configuration may promote unrestricted fluid flow through spaces 69, 71 and bores 77.

Primary rim 98 may be configured to contact the adjacent components (e.g. manifold 50 and bead 81), to counteract any bending moment, and to maintain the seal provided by central rim 100 and conduit rim 102. The surface area of the primary rim 98 may be sized relative to central rim 100 and conduit rim 102 to ensure a sufficient load is distributed to central rim 100 and conduit rim 102. For example, the surface area of primary rim 98 may be less than the surface area of conduit rim 102 and greater than the surface area of central rim 100. In some embodiments, primary rim 98 may account for about 35% of the total contact area between barrel 74 and the adjacent components, while central rim 100 and conduit rim 102 may, respectively, account for about 45% and 20% of the total contact area.

A lower end of each push rod 46 may extend through manifold 50 into central bore 79 and engage (or be connected to) plunger 80, in this way, the reciprocating movement of push rod 46 may translate into a sliding movement of plunger 80 between a Bottom-Dead-Center position (BDC) and a Top-Dead-Center (TDC) position within barrel 74.

Head 81 may house valve elements that facilitate fluid pumping during the movement of plungers 80 between BDC and TDC positions. Specifically, head 81 may include a first check valve 82 associated with inlet flow, and a second check valve 84 associated with outlet flow. During plunger movement from BDC to TDC (upward movement in FIG. 2), pressurized fluid from an external boost pump (not shown) may unseat an element of valve 82, allowing the fluid to be directed into barrel 74. This fluid may flow from enclosure 66 through one or more passages 86 into barrel 74. During an ensuing plunger movement from TDC to BDC (downward movement in FIG. 2), high pressure may be generated within barrel 74 by the volume contracting inside barrel 74. This high pressure may function to reseat the element of valve 82 and unseat an element of valve 84, allowing fluid from within enclosure 66 to be pushed out through one or more passages of head 81. Then during the next plunger movement from BDC to TDC, the element of valve 84 may be reseated. One or both of the elements of valves 82 and 84 may be spring-biased to a particular position, if desired (e.g., toward their seated and closed positions). The flow being discharged from barrel 74 through passage 88 may be directed through an axially oriented passage 90 formed within a wall of barrel 74. All high-pressure flows from passages 90 of all pumping mechanisms 48 may then join each other inside manifold 50 for discharge from pump 10 via high-pressure outlet 58.

Figure 4:
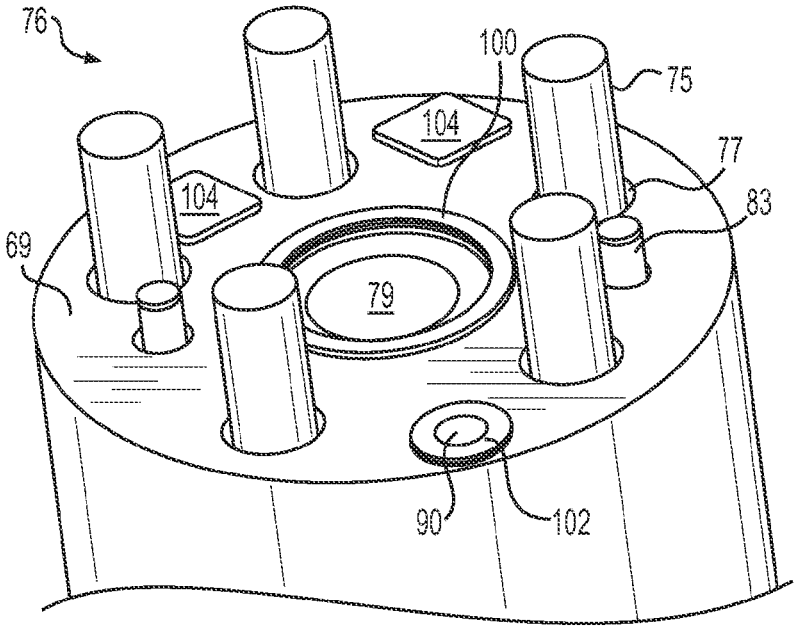
FIG. 4 is an alternative embodiment of the end portion of the pump as shown in FIGS. 1 and 2.

In an alternative embodiment, as depicted in FIG. 4, the stabilizer may include one or more pads 104, which may replace the function of rim 98. Distal end 76 may include any number of pads 104 in any number of configurations to stabilize pumping mechanism 48. As depicted in FIG. 4, barrel 74 may have first and second pads 104 positioned equidistant between adjacent bores 75 and diametrically opposite of conduit rim 102 with respect to the longitudinal axis. Pads 104 may be defined by a cross-section having a length less than about three times the size of a width such that it would be less sensitive to small variations in manufacturing. In some embodiments, as depicted in FIG. 4, Pads 104 may be substantially square shaped. Pads 104 may be provided with the same height and surface area as primary rim 98.

INDUSTRIAL APPLICABILITY

The disclosed pump finds potential application in any fluid system where heat transfer through the pump is undesirable, or where thermal gradients are undesirable The disclosed pump finds particular applicability in cryogenic applications, for example in power system applications having engines that combust LNG fuel. One skilled in the art will recognize, however, that the disclosed pump could be utilized in relation to other fluid systems that may or may not be associated with a power system. The disclosed pump may provide favorable heat dissipation within the pump by exposing internal surfaces of the pump to the cooling fluid. Operation of pump 10 will now be explained.

Referring to FIG. 1, when driveshaft 14 is rotated by an engine for another power source), load plate 30 may be caused to undulate in an axial direction. This undulation may result in translational movement of tappets 42 and corresponding movements of push rods 46 and engaged plungers 80. Accordingly, the rotation of driveshaft 14 may cause axial movement of plungers 80 between TDC and BDC positions. During this time, LNG fuel (or another fluid) may be supplied from an external storage tank (not shown) to enclosure 66 via common inlet 56. In some embodiments, the fluid may be transferred from the storage tank to pump 10 via a separate boost pump (not shown), if desired.

As plungers 80 cyclically rise and fall within barrels 74, this reciprocating motion may function to allow fluid to flow from enclosure 66 through head 81 (i.e., through passages 86 and past check valve 82) into barrels 74 and to push the fluid from barrels 74 via head 81 (i.e., via passage 88 and past check valve 84) at an elevated pressure. The high-pressure fluid may flow through passages 90 in barrels 74 and through high-pressure outlet 58 back to the engine.

Fluid from enclosure 66 may also be at least partially dispersed throughout spaces 69, 71 and bores 77 to provide favorable cooling effects to the internal surfaces of manifold 50, barrel 74, head 81, and bolts 75. The cooling effect may reduce the thermal distortion and stress challenges of pumping mechanism 48, which may experience extreme temperatures ranges of hot ambient temperatures (up to 50° C.) down to cryogenic fluid temperature (e.g. −196° C. for nitrogen). The fluid may also act as a lubricant to reduce the heat created by friction between the components of the bolted joints of pumping mechanics 48. The favorable heat dissipation may increase longevity of pump 10.

It will be apparent to those skilled in the art that various modifications and variations can be made to the pump of the present disclosure. Other embodiments of the pump will be apparent to those skilled in the art from consideration of the specification and practice of the exemplary pump disclosed herein. For example, spaces 69, 71 may be replaced or supplemented with holes (not shown) drilled through the wall of barrel 74 to provide fluid communication between enclosure 66 and bores 77. It is also contemplated that rims 98, 100, 102 may be positioned on manifold 50 and head 81, instead of base and distal ends 76, 78 of barrel 74. It is intended that the specification and examples be considered as exemplary only, with a true scope being indicated by the following claims and their equivalents.

What is claimed is:

1. A pump barrel, comprising:

an elongated body having a first end and a second end;

at least one bore extending through the elongated body from the first end to the second end; and a stabilizer positioned on the first end and at least partially defining a space in fluid communication with the at least one bore, wherein the at least one bore is configured to receive a bolt, and a radial dimension between the pump barrel and the bolt is equal to a height dimension of the stabilizer.

2. The pump barrel of claim 1, wherein the stabilizer includes a primary rim that extends along less than 180° of a circumference of the elongated body.

3. The pump barrel of claim 2, wherein the primary rim extends along 144° of the circumference.

4. The pump barrel of claim 1, wherein the at least one bore includes a plurality of bores in communication with the space.

5. The pump barrel of claim 4, wherein the plurality of bores includes five bores, and the stabilizer extends around only three of the five bores.

6. The pump barrel of claim 5, further including:

a central bore passing from the first end through the second end at a location centered between the plurality of bores; and a central rim circumventing around the central bore.

7. The pump barrel of claim 6, wherein the central bore has a diameter that is larger than a diameter of the plurality of bores and is configured to receive a plunger.

8. The pump barrel of claim 7, further including:

a peripheral bore passing from the first end through the second end; and a conduit rim circumventing around the peripheral bore.

9. The pump barrel of claim 8, wherein the conduit rim is positioned diametrically opposite the stabilizer relative to a longitudinal axis of the elongated body.

10. The pump barrel of claim 9, further including a second stabilizer positioned on the second end of the barrel and at least partially defining a second space in communication with the at least one bore.

11. The pump barrel of claim 1, wherein the stabilizer includes one or more pads.

12. A pump barrel comprising:

an elongated body having a first end, a second end, and a longitudinal axis;

a plurality of bores passing from the first end through the second end;

a central bore passing from the first end through the second end at a location centered between the plurality of bores;

a peripheral bore passing from the first end through the second end;

a first stabilizer positioned on the first end and at least partially defining a first space in communication with the plurality of bores;

a second stabilizer positioned on the second end and at least partially defining a second space in communication with the plurality of bores;

a first central rim on the first end circumventing around the central bore;

a second central rim on the second end circumventing around the central bore;

a first conduit rim on the first end circumventing around the peripheral bore at a location diametrically opposite the first central rim relative to the longitudinal axis; and a second conduit rim on the second end circumventing around the peripheral bore and diametrically opposite the second stabilizer relative to the longitudinal axis.

13. A pump comprising:

a barrel including:

an elongated body having a first end and a second end;

a plurality of bores passing from the first end through the second end;

a central bore passing from the first end through the second end at a location centered between the plurality of bores;

a first stabilizer positioned on the first end and at least partially defining a first space in communication with the plurality of bores;

a second stabilizer positioned on the second end and at least partially defining a second space in communication with the plurality of bores;

a first central rim on the first end circumventing around the central bore; and a second central rim on the second end circumventing around the central bore;

a plunger positioned within the central bore;

a manifold positioned on the first end of the barrel;

a head positioned on the second end of the barrel; and a plurality of bolts positioned within the plurality of bores to secure the barrel between the manifold and the head.

14. The pump of claim 13, further including:

a peripheral bore extending between the first end and the second end;

a first conduit rim on the first end of the barrel and circumventing around the peripheral bore; and a second conduit rim on the second end of the barrel and circumventing around the peripheral bore.

15. The pump of claim 13, further including an annular space defined between the bolts and the plurality of bores.

16. The pump of claim 13, wherein the annular space defines a radial dimension about equal to a height dimension of the first stabilizer.

17. The pump of claim 13, wherein the first stabilizer has a height about 4-10% of a diameter of the central bore.

18. The pump of claim 13, wherein the first stabilizer extends along 144° of a circumference of the first end.

19. The pump of claim 18, wherein the plurality of bores includes five bores, and the first stabilizer extends around only three of the five bores.

* * * * *